US005740576A

United States Patent [19]

Sebor et al.

[11] Patent Number: 5,740,576

[45] Date of Patent: Apr. 21, 1998

[54] DEVICE FOR DISLODGING A SUBMERSIBLE SWIMMING POOL CLEANER

[75] Inventors: Pavel Sebor, Heathrow; Brian H. Phillipson, Longwood, both of Fla.

[73] Assignee: Wattatec, L.P., Heathrow, Fla.

[21] Appl. No.: 715,715

[22] Filed: Sep. 19, 1996

[51] Int. Cl.[6] ..... E04H 4/16; A47L 1/00; B60S 1/00

[52] U.S. Cl. ..... 15/1.7; 15/246

[58] Field of Search ..... 134/18, 21; 15/1.7, 15/246, 246.2

[56] References Cited

U.S. PATENT DOCUMENTS

| | | | |
|---|---|---|---|
| 3,439,368 | 4/1969 | Myers | 15/1.7 |
| 4,521,933 | 6/1985 | Raubenheimer | 15/1.7 |
| 4,837,886 | 6/1989 | Rawlins | 15/1.7 |
| 4,920,599 | 5/1990 | Rief | 15/1.7 |
| 5,014,382 | 5/1991 | Kallenbach | 15/1.7 |
| 5,077,853 | 1/1992 | Campbell | 15/1.7 |
| 5,097,559 | 3/1992 | Brunt et al. | 15/1.7 |
| 5,197,158 | 3/1993 | Moini | 15/1.7 |
| 5,226,205 | 7/1993 | Pearce | 15/1.7 |
| 5,259,082 | 11/1993 | Sebor | 15/1.7 |
| 5,404,607 | 4/1995 | Sebor | 15/1.7 |

FOREIGN PATENT DOCUMENTS 2005993 5/1979 United Kingdom .

2153209 8/1985 United Kingdom .

*Primary Examiner*—Marian C. Knode
*Assistant Examiner*—Ali R. Salimi
*Attorney, Agent, or Firm*—Allen, Dyer, Doppelt, Milbrath & Gilchrist, P.A.

[57] ABSTRACT

A steering device is attached to a submersible swimming pool cleaner for aiding in turning the cleaner away pool side wall engaging positions and thus allowing the cleaner to move across pool surfaces for performing its cleaning function. The steering device includes elongated rods extending from a connector fitting attached to the pool cleaner hose connector. Driven gears of the pool cleaner connector drive the steering device and cause rod ends engaging a pool side wall to lift and push the cleaner away from the side wall. The fitting and thus the rods are freely rotatable through a limited arc about an axis of rotation of the connector, defined by movement of a gear tooth between stop prongs. The ability of the rods to rotate freely within this arc overcomes a problem of excess drag to the cleaner by the steering device. Further, the rods extend radially outward and downward form the fitting such that the rod tips engage the side wall and initiate a ratchet-like action against the side wall surface which results in an upward force acting on the cleaner for reducing friction between cleaner ground engaging portions and the pool bottom wall surface, thus making it easier to rotate the cleaner for movement along pool surfaces to be cleaned.

24 Claims, 5 Drawing Sheets

DEVICE FOR DISLODGING A SUBMERSIBLE SWIMMING POOL CLEANER

BACKGROUND OF INVENTION

1. Field of Invention

The invention relates generally to steering of swimming pool cleaners, and more particularly to the steering of pool cleaners operable with a suction hose attached to a rotatably driven hose coupling.

2. Description of Background Art

Typically, when the contour of a pool surface is such that a portion of the cleaner body is able to contact the pool side walls while another portion of the cleaner is in contact with the pool bottom surface, the cleaner has a likely chance of becoming stuck against the pool surfaces. This is often the case for pool side walls which are generally perpendicular to the pool bottom surface, a "square bottomed" pool. In such circumstances, the drag induced on the cleaner body will over-ride or may substantially impair the cleaner operation and its normal steering operations, causing the cleaner to remain in one position or stay at that position for an inordinate amount of time. Further, the cleaner may be forced to travel parallel to the side wall, or along pool steps. The results are improper pool cleaner operation and an inadequate pool cleaning.

U.S. Pat. No. 4,521,933 describes a random steering device for a submerged suction cleaning head for cleaning swimming pools in which there is a suction hose connecting with the head in a direction generally perpendicular to the surface on which the suction head moves. The steering device operates by intermittently applying torque about the axis of the suction hose where it enters the suction head. The torque is applied by a water motor driven by water flowing from the suction head along the suction hose.

U.S. Pat. No. 5,404,607 describing a self-propelled submersible suction cleaner transfers a vibratory movement of an oscillator located within a flow path of a suction chamber for propulsion of the cleaner over a submerged surface of a pool. The oscillator vibratory movement is also converted to a unidirectional rotation of a gear train for rotating the cleaner to improve on the random movement of the cleaner over the pool surface and to maneuver the cleaner away from obstacles such as pool steps which can often stop cleaner movement, as earlier suggested. Flow through the cleaner flow path is caused by connecting the suction chamber to a filter pump and motor by a flexible hose, well known in the art. The hose is connected to a pool cleaner coupling which is rotatably connected to the gear train for rotating the coupling and thus the cleaner about the flexible hose. By its very nature, the flexible hose has rotational play and does not completely transfer the rotational forces applied by the rotating coupling to rotation of the cleaner.

The present invention provides an additional steering mechanism for such pool cleaners by providing a level of steering force from other than the rotating flexible hose.

SUMMARY OF INVENTION

It is an object of the present invention to aid in the steering of pool cleaners. Further, it is an object to provide steering to a cleaner which typically relies on rotating of a hose connector for turning the cleaner. It is further an object of the invention to provide steering for a pool cleaner employing steering forces derived from other than a rotation of a flexible hose, and to provide steering for a cleaner that has no other steering mechanisms.

This and other objects, advantages, and features of the present invention are provided by a steering device useful with a submersible pool cleaner having a rotatably driven hose connector. The steering device comprises a fitting for engaging a cleaner hose connector, multiple elongated rods radially extending from the fitting, each rod having a proximal end attached to the fitting for extending the rod radially outward from the connector, the rod having a length dimension for extending a rod distal end beyond a perimeter plane of the cleaner for preventing the cleaner from contacting a pool side wall surface during movement of the cleaner over a pool bottom wall surface, and means for rotating the connector and thus the fitting for moving the rods about the connector axis, whereby the rod distal end engages the pool side wall for biasing the rod distal end against the side wall for turning the cleaner.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
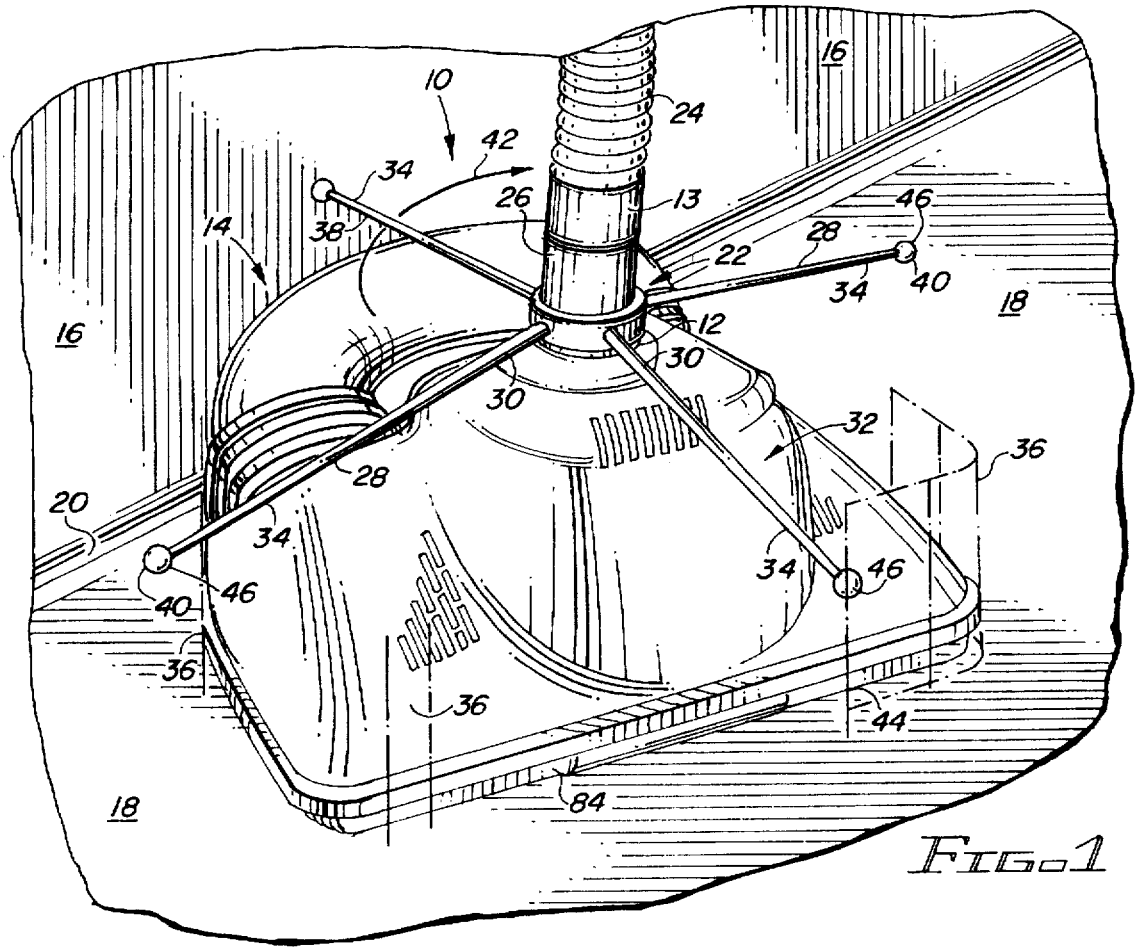
FIG. 1 is a perspective view of a pool cleaner steering device operable with a submersible swimming pool cleaner.

Referring now to FIG. 1, a preferred embodiment of a steering device 10 of the present invention is attached to a swivel hose connector 12 of a pool cleaner 14 having a style as described in the Sebor '607 patent referenced earlier in the background section of this specification. The connector 12 is typically tapered for easy attachment of a hose end connector 13. As illustrated here, by way of example, if a pool side wall surface 16 and bottom surface 18 have a small transition radius surface 20, as is typical for the square-bottomed swimming pools, the device 10 engages the side wall surface 16 and provides a bias against the side wall surface 16 with sufficient force provided by the torque of the rotating connector 12 for turning the cleaner away from the side wall surface 16 thereby enabling the cleaner 14 to continue on its intended path along the pool surfaces to be cleaned. It is anticipated that alternate cleaner structures will have a driven rotatable member where the device 10 can be attached for operation as herein described.

Figure 2:
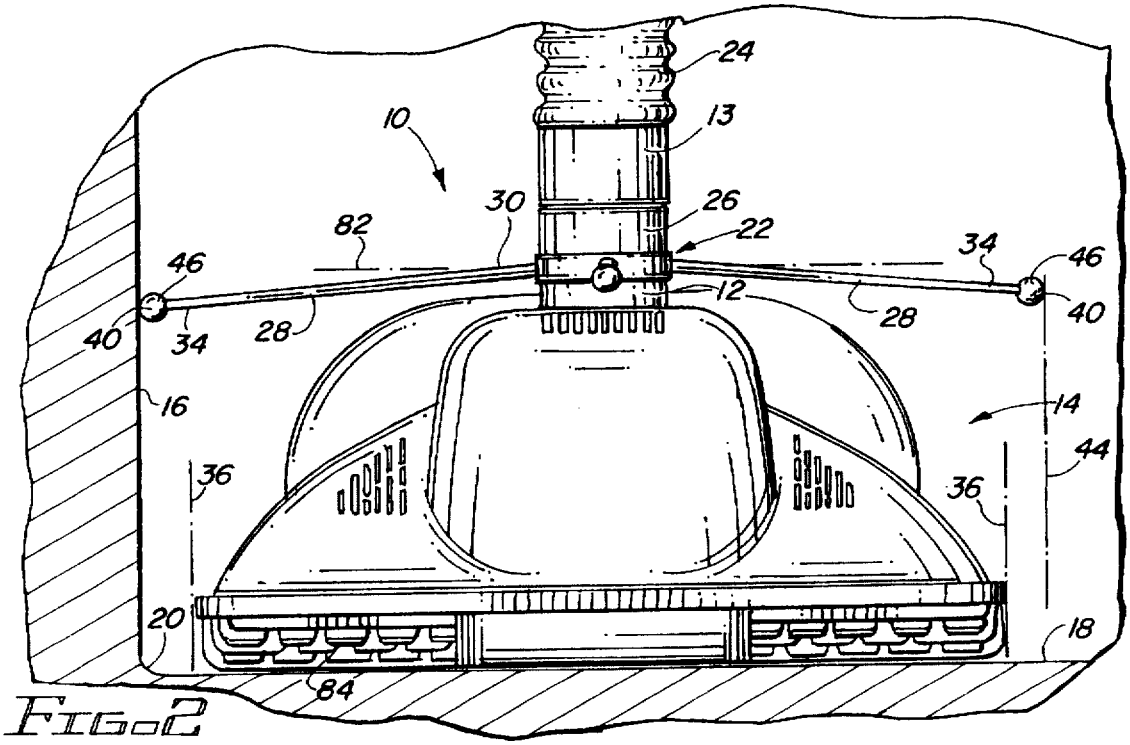
FIG. 2 is a rear view of the cleaner and steering device of FIG. 1.
Figure 3:
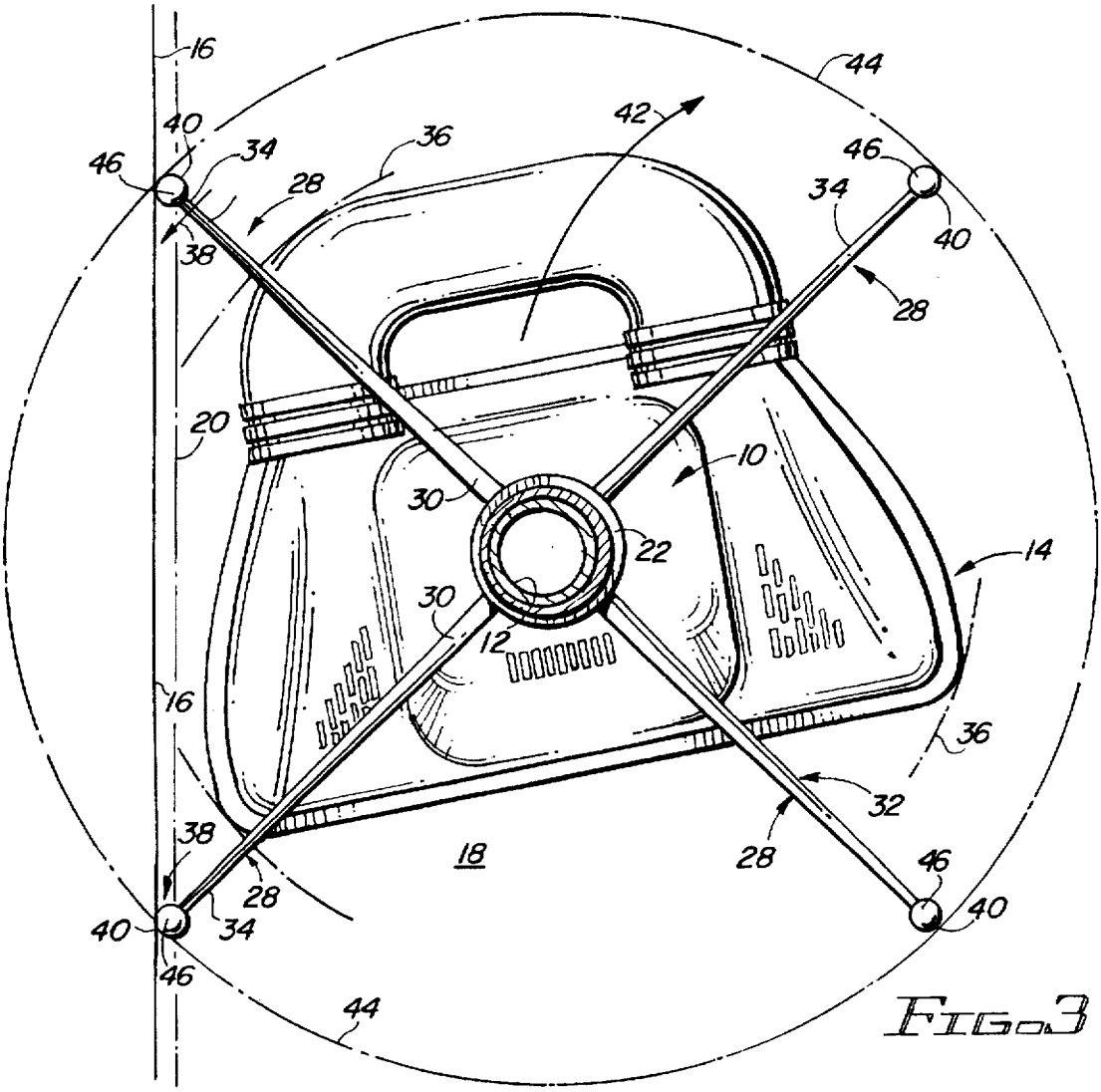
FIG. 3 is a top plan view of the cleaner and steering device of FIG. 1.

As illustrated with reference to FIGS. 2 and 3, and again with reference to FIG. 1, the device 10 herein described is attached to the pool cleaner hose connector 12. For the embodiment herein described by way of example, a central tubular fitting 22 is friction fitted to the pool cleaner swivel hose connector 12. To conform with a tapered connector 12, the fitting 22 will have a tapered bore 23, as illustrated with reference to FIG. 4. Alternate connecting surfaces are anticipated for accommodating alternate connector structures. A hose is then attached to a top portion 26 of the fitting 22. As illustrated with reference to FIGS.1 through 3, the device 10 includes elongated rods 28 having a proximal end 30 attached to the fitting 22 and which extend radially outward from the fitting 22. The rods 28 have a length 32 such that a rod distal end 34 is positioned beyond a perimeter plane 36 of the cleaner 14. At least part of the device 10 needs to extend beyond the dimensions of the cleaner 14 and by way of example with the Sebor '607 cleaner 14 beyond its housing and ground engaging mechanism, so that the cleaner 14 can operate as intended including rotating without touching the side wall surface 16. With such a length 32, the rod distal end 34 will make contact with the pool side wall surface 16 during rotation of the connector 12, the attached fitting 22, and thus the rods 28. As indicated by arrow 38, again with reference to FIG. 3, resultant forces on the side wall surface 16 through contact of rod distal end tip 40 with and biasing against the pool side wall surface 16. The tip 40 is placed in frictional contact with the side wall surface 16. With such biasing, the cleaner 14 is turned in an opposite direction as illustrated with arrow 42 and thus permitted to move away from the side wall surface 16 to complete its intended task. The biasing herein described provides additional turning or steering forces that otherwise are not provided by the simple twisting of the hose 24 caused by the rotation of the connector 12.

Figure 3A:
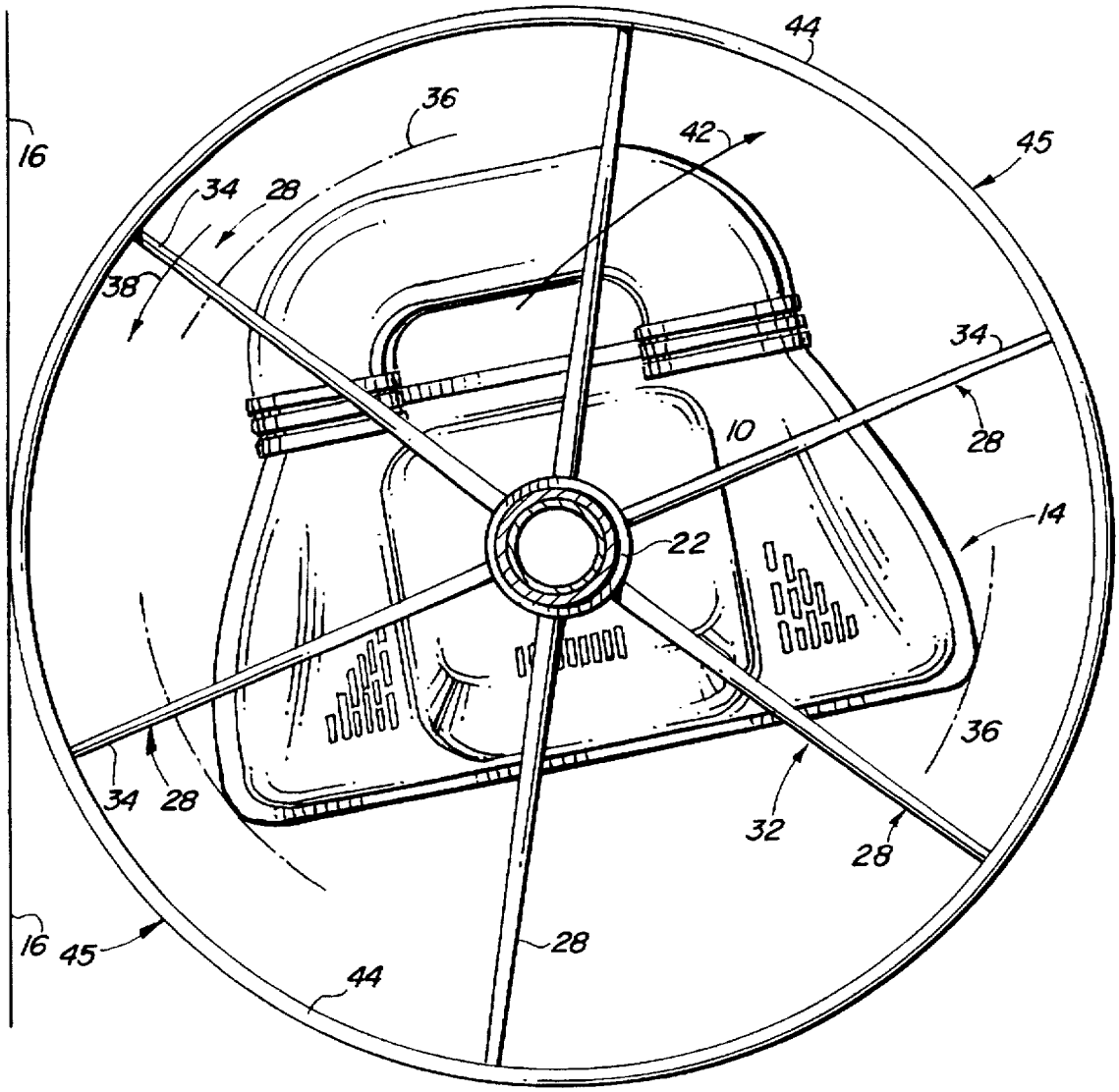
FIG. 3*a* is a top plan view of an alternate embodiment of the steering device of FIG. 1.
Figure 4:
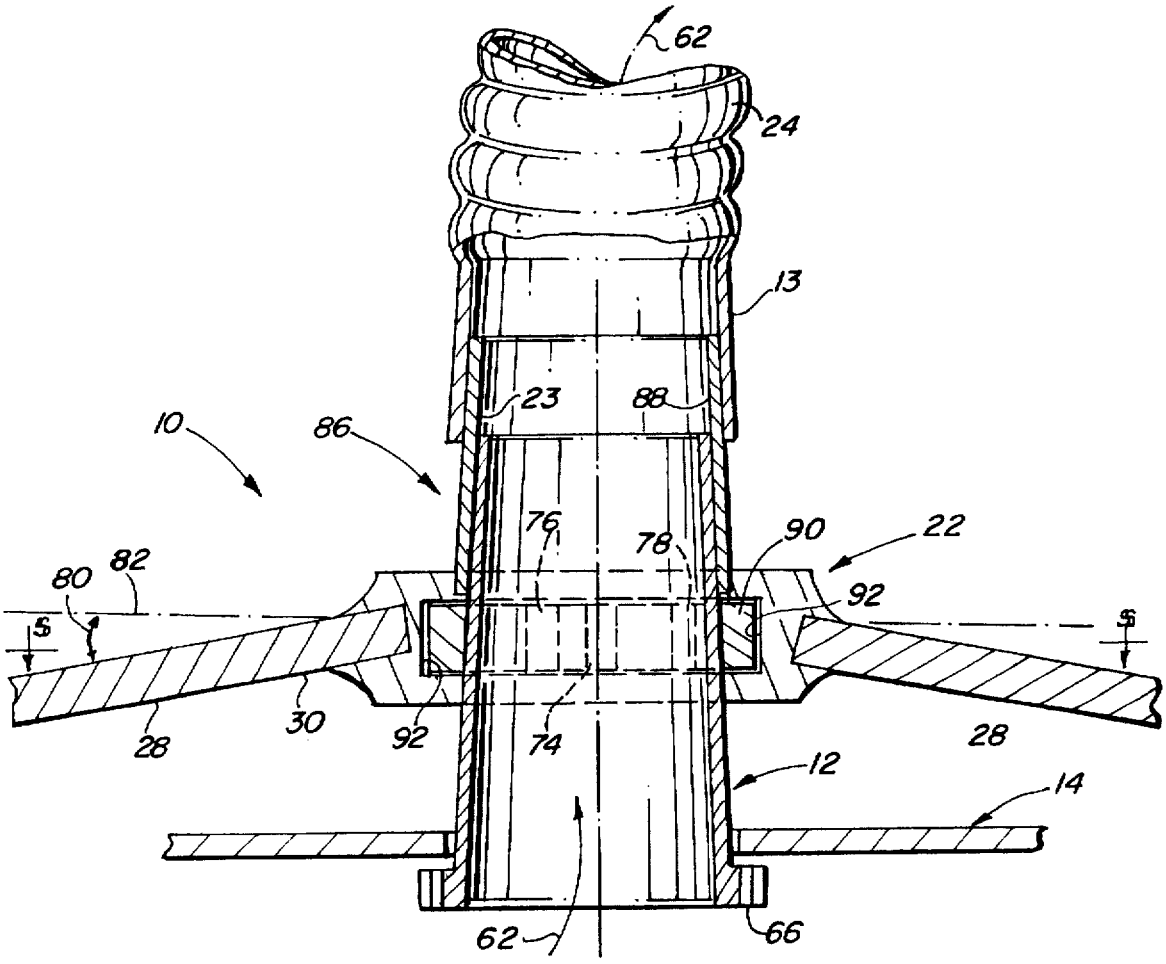
FIG. 4 is a partial cross-sectional side view of the steering device of a preferred embodiment of the present invention.
Figure 5:
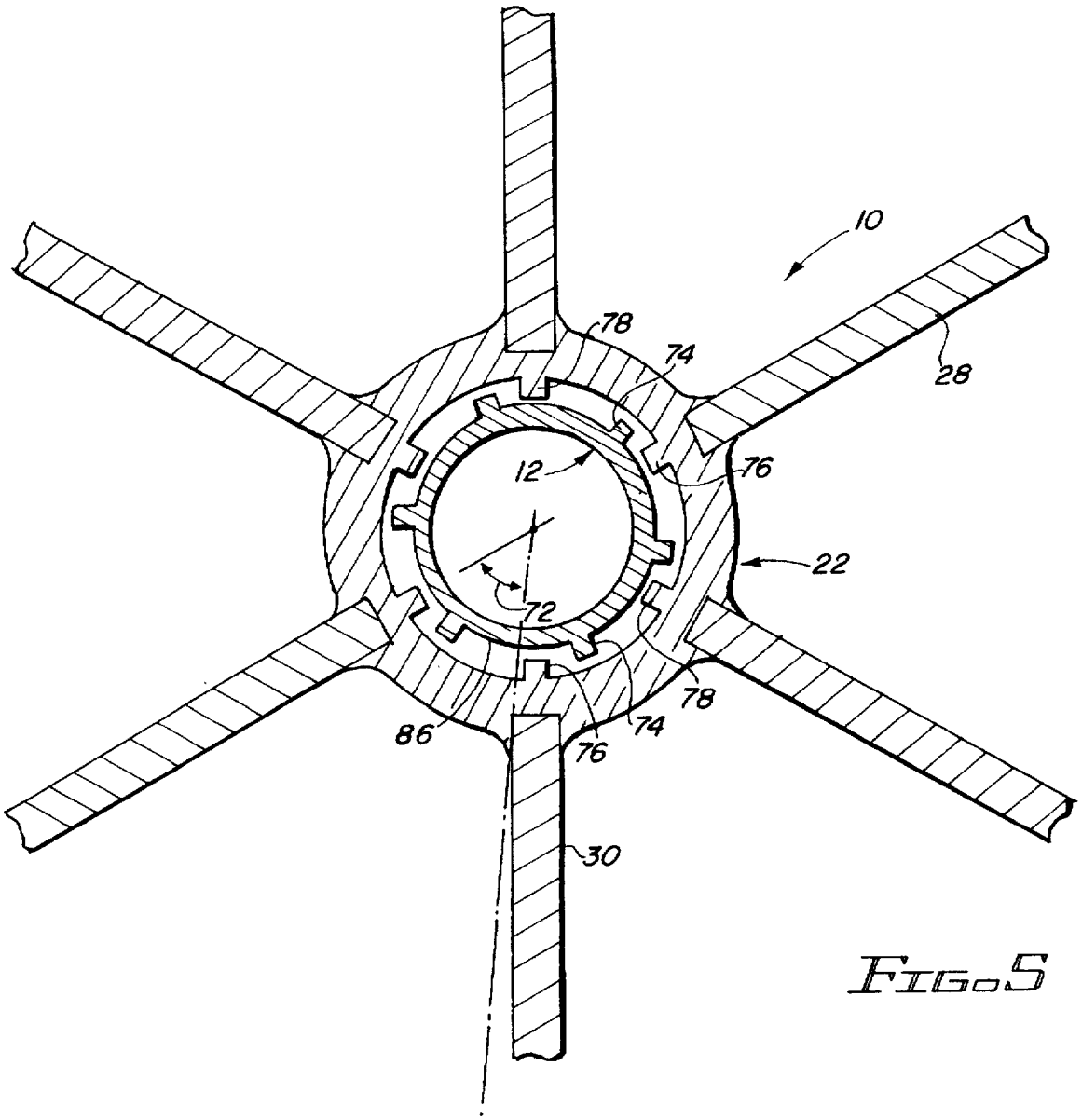
FIG. 5 is a partial cross-sectional top plan view of the steering device of FIG. 4.

In a preferred embodiment of the present invention, the steering device 10, as illustrated with reference to FIGS. 4 and 5, is removably attached to the pool cleaner driven hose connector 12, earlier described. It is anticipated that alternate embodiment include a device 10 integrally formed with the cleaner 14, such as with the cleaner connector 12. Further, in the embodiment herein described, rods 28 have equivalent lengths 32, wherein the tips 40 lie within a circular locus 44, varying length rods 28 are anticipated for specific alternate uses. Further, connecting tips 40 can form a ring or shape 45 extending beyond the cleaner perimeter plane 36, as illustrated with reference to FIG. 3*a*. Further, in one preferred embodiment of the device, six rods 28 are described, as illustrated again with reference to FIG. 5, the rods 28 acting as spokes extending from a rotating hub. It is anticipated that each rod 28, in one embodiment, can be removed for replacement. In another preferred embodiment, the device 10 includes the rods 28 integrally formed with the tubular fitting 22. The tip 40 includes rubber tip elements 46, as illustrated again with reference to FIGS. 1, 2 and 3, in one embodiment.

Figure 6:
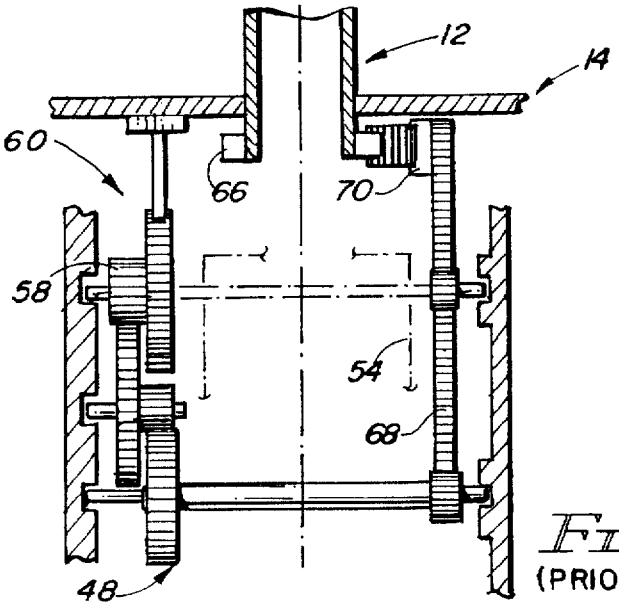
FIG. 6 (PRIOR ART)
FIG. 6 is a partial cross-sectional view of a prior art drive gear assembly and rotatably driven cleaner connector.
Figure 7:
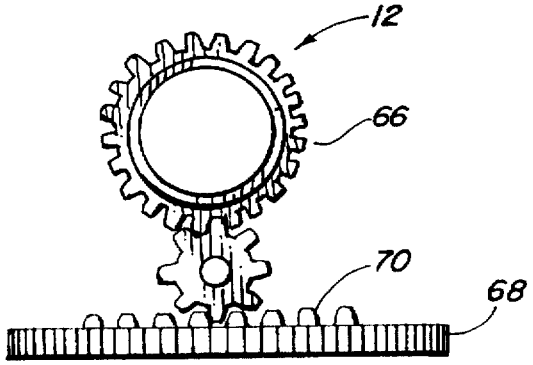
FIG. 7 (PRIOR ART)
FIG. 7 is a partial top view of a prior art pool cleaner connector illustrating engagement of the drive gear assembly with connector gear teeth.
Figure 9:
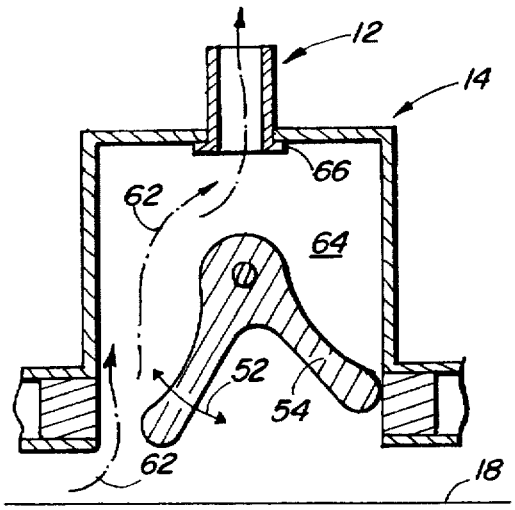
FIG. 9 (PRIOR ART)
FIG. 9 is a partial cross-sectional side view of a prior art pool cleaner suction chamber illustrating operation of the oscillator with water flow through the chamber.
Figure 8:
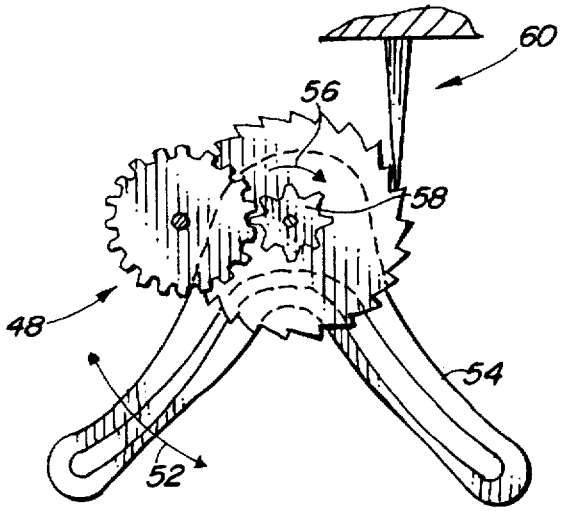
FIG. 8 (PRIOR ART)
FIG. 8 is a partial view of the prior art drive gear assembly of FIG. 6 operable with a pool cleaner oscillator.

Again with reference to FIGS. 4 and 5, a preferred embodiment of the invention includes the connector 12 rotatably driven by a cleaner drive gear assembly 48, by way of example, as described in the Sebor '607 patent, and as herein illustrated with reference to FIGS. 6, 7 and 8. A driven gear 50 rotates during movement of the cleaner 14 through translation of reciprocating angular movement 52 of an oscillator 54 into a unidirectional rotation 56 of a driving gear 58 through the use of a ratchet and pawl assembly 60. As described in the Sebor '607 patent, water flow 62 through a cleaner chamber 64 and out through the connector 12, as illustrated with reference to FIG. 9, imposes a vibratory motion to the oscillator 54, a vibratory movement to the cleaner 14, and its movement across pool surfaces during cleaner operation. The driven gear 58 is used within the drive gear assembly 48 to engage connector gears 66 for rotating the connector 12 and providing the torque to the hose 24 for turning the cleaner 14 and steering device 10, as earlier described. The gear assembly 48 can be arranged for alternately turning the cleaner 14 in opposing directions.

Typically, an interval gear 68 contains a compliment of teeth, as illustrated again with reference to FIGS. 6 and 7, interval gear teeth 70, arranged for rotating the cleaner 14 through an arc of rotation and may release any torque applied to the hose after the turn. With this arrangement, excess twisting of the hose 24 is eliminated. The device 10 provides the driving forces against the pool side wall surface 16 to move the cleaner 14 away from the surface 16 and overcome this relaxing of hose torque. Thus, as earlier described, the rods 28 of the steering device 10 frictionally engage the surface 16 and effectively hold the cleaner 14 away from the side wall surface 16 to permit movement of the cleaner 14 away from the surface 16.

Once the steering device 10 has freed the cleaner 14 for normal movement, it has been found that the cleaner 14 will tend to travel generally parallel to and along the pool side wall surface 16. It is therefore important that the device 10 not add drag to the cleaner 14 through biasing forces against the side wall surfaces. In a preferred embodiment of the invention, again illustrated with reference to FIG. 5, the fitting 22 and thus the rods 28 are freely rotatable through a limited arc 72 defined by movement of a first tooth or prong 74 between stop prongs 76, 78. In one embodiment of the present invention, this arc 72 is approximately sixty degrees. The ability of the rods 28 to rotate freely within this arc 72 overcomes the problem of excess drag to the cleaner 14 by the device 10. In one preferred embodiment of the invention, the prongs 74, 76, 78 are angled 80 downwardly from a horizontal plane 82 passing therethrough, as are the rods 28. With such an arrangement for the rods 28, when the tips 40 engage the side wall 16, the angled rods 28 initiate a ratchet-like action against the side wall surface 28 which results in an upward force acting on the cleaner 14. Such an upward force reduces friction between cleaner ground engaging means 84 and the pool bottom wall surface 18, making it easier to rotate the cleaner 14.

In one embodiment of the present invention, and as illustrated again with reference to FIGS. 4 and 5, the fitting 22 includes a sleeve 86 which receives the pool cleaner connector 12. The sleeve 86 includes a distal end 88 for engaging the hose connector 13 and a sleeve proximal end 90 having the first prong 74 herein earlier described. In this embodiment, six prongs 74 are used but other amounts are applicable depending the arc 72 or structure preselected. The sleeve proximal end 90 is rotatably attached within a fitting retaining groove 92 which has the stop prongs 76, 78, earlier described attached within the groove 92. It is anticipated that alternate structures will be devised that permit the limited rotation of the rods 28 about a connector axis without departing from the teaching of the present invention.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

What is claimed is:

1. A swimming pool cleaner comprising:

a hose;

a cleaner housing;

a connector rotatably carried by the housing, the connector in fluid communication with the hose;

a chamber formed within the housing, the chamber in fluid communication with the connector;

an oscillator carried within the chamber such that fluid flow through the chamber to the connector provides a vibratory motion to the oscillator;

gear means communicating between the connector and the oscillator for providing a rotational movement to the connector;

a fitting carried by the connector;

multiple elongated rods radially extending from the fitting, each rod having a proximal end attached to the fitting for extending the rod radially outward from the connector, each rod having a length dimension for extending a rod distal end beyond a perimeter plane of the cleaner housing for preventing the housing from contacting a pool side wall surface during movement of the cleaner over a pool bottom wall surface; and wherein the gear means rotates the connector and thus the fitting for rotating the rods about the connector, the rod distal end engaging the pool side wall for biasing the rod distal end against the side wall thus turning the cleaner.

2. The cleaner according to claim 1, further comprising a ring extending beyond the housing perimeter plane, the ring carried by the rod distal ends.

3. The cleaner according to claim 1, wherein each rod attached to the fitting is removable.

4. The cleaner according to claim 1, wherein each rod distal end comprises a rubber tip for providing enhanced frictional contact between the distal end and the pool side wall.

5. The cleaner according to claim 1, wherein the rods further extend radially outward from the fitting in a downwardly angled direction.

6. The cleaner according to claim 1, further comprising:

a sleeve for closely receiving the connector, the sleeve having a distal end for engaging the hose and a proximal end for rotatably receiving the fitting;

stop means having multiple prongs carried by the fitting and sleeve, the stop means having at least one prong freely moveable between at least one prong pair for limiting rotation of the fitting about the sleeve within an arc defined by a prong pair separation.

7. The cleaner according to claim 6, wherein the arc is sixty degrees.

8. The cleaner according to claim 6, wherein the stop means further comprises multiple prongs radially extending from the sleeve proximal end and the fitting having a groove for engaging the sleeve prongs, the fitting further having multiple prongs within the groove for communicating with the sleeve grooves in limiting free rotation of the fitting about the sleeve, and thus limiting free rotation of the rods about the connector.

9. A swimming pool cleaner comprising:

a connector rotatably driven during operation of the cleaner;

a fitting carried by the connector; and an elongated rod extending radially outward from the fitting, the rod having proximal and distal ends, the proximal end attached to the fitting and the distal end extending beyond a cleaner perimeter, the rod distal end engaging a pool side wall for turning the cleaner during rotation of the connector.

10. The cleaner according to claim 9, further comprising multiple rods and a ring carried by the rod distal ends for frictionally engaging the pool side wall.

11. The cleaner according to claim 9, wherein the rod is removable attached to the fitting.

12. The cleaner according to claim 9, wherein the rod distal end comprises a rubber tip for providing enhanced frictional contact with the pool side wall.

13. The cleaner according to claim 9, wherein the rod further extends radially outward from the fitting in a downwardly angled direction.

14. The cleaner according to claim 9, further comprising:

a sleeve for closely receiving the connector, the sleeve having a distal end for engaging a hose and a proximal end for rotatably receiving the fitting; and a stop means having multiple prongs carried by the fitting and sleeve, the stop means having at least one prong freely moveable between at least one prong pair for limiting rotation of the fitting about the sleeve within an arc defined by a prong pair separation.

15. The cleaner according to claim 14, wherein the stop means further comprises multiple prongs radially extending from the sleeve proximal end and the fitting having a groove for engaging the sleeve prongs, the fitting further having multiple prongs within the groove for communicating with the sleeve grooves in limiting free rotation of the fitting about the sleeve, and thus limiting free rotation of the rods about the connector.

16. A swimming pool cleaner steering device comprising:

a sleeve having a distal end for engaging a cleaner hose and a proximal end for rotatably receiving a fitting;

a fitting rotatably attached to the sleeve proximal end;

multiple elongated rods radially extending from the fitting, each rod having a proximal and distal ends, the proximal ends attached to the fitting, each rod having a length dimension for extending each rod distal end beyond a perimeter plane of the cleaner for limiting cleaner contact with a pool side wall surface during movement of the cleaner over a pool bottom wall surface; and stop means having multiple prongs carried by the fitting and sleeve, the stop means having at least one prong freely moveable between at least one prong pair for limiting rotation of the fitting between the prong pair, thus limiting rotation of the rods about the connector.

17. The cleaner device according to claim 16, further comprising a ring extending beyond the housing perimeter plane, the ring carried by each rod distal end.

18. The cleaner device according to claim 16, wherein each rod distal end comprises a rubber tip for providing enhanced frictional contact between the distal end and the pool side wall.

19. The cleaner device according to claim 16, wherein the rods further extend radially outward from the fitting in a downwardly angled direction.

20. The cleaner device according to claim 16, wherein the stop means further comprises multiple prongs radially extending from the sleeve proximal end and the fitting having a groove for engaging the sleeve prongs, the fitting further having multiple prongs within the groove for communicating with the sleeve grooves in limiting free rotation of the fitting about the sleeve, and thus limiting free rotation of the rods about the connector.

21. A swimming pool cleaner steering device comprising:

a fitting for attaching to a cleaner hose connector; and an elongated rod radially extending from the fitting, the rod having proximal and distal ends, the proximal end attached to the fitting, the rod having a length dimension for extending the rod distal end beyond a perimeter plane of the cleaner for contacting a pool side wall surface during movement of the cleaner over a pool bottom wall surface.

22. The cleaner steering device according to claim 21, further comprising;

second rods radially extending from the fitting; and a ring carried by each rod distal end for frictional engagement between the pool side wall and the ring.

23. The cleaner steering device according to claim 21, further comprising:

a sleeve for receiving the connector, the sleeve having a distal end for engaging a hose and a proximal end for rotatably receiving the fitting; and stop means having multiple prongs carried by the fitting and sleeve, the stop means having at least one prong freely moveable between at least one prong pair for limiting rotation of the fitting about the sleeve within an arc defined by a prong pair separation.

24. The cleaner steering device according to claim 21, wherein the rod distal end comprises a rubber tip for providing enhanced frictional contact with the pool side wall.

* * * * *